US009511489B2

(12) United States Patent
Nilsson

(10) Patent No.: US 9,511,489 B2
(45) Date of Patent: Dec. 6, 2016

(54) IMPACT MECHANISM, ROCK DRILL AND DRILL RIG COMPRISING SUCH IMPACT MECHANISM

(75) Inventor: Ulf Nilsson, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 511 days.

(21) Appl. No.: 13/261,736

(22) PCT Filed: Apr. 24, 2012

(86) PCT No.: PCT/SE2012/050428

§ 371 (c)(1),
(2), (4) Date: Sep. 12, 2013

(87) PCT Pub. No.: WO2012/148347

PCT Pub. Date: Nov. 1, 2012

(65) Prior Publication Data

US 2014/0027138 A1 Jan. 30, 2014

(30) Foreign Application Priority Data

Apr. 27, 2011 (SE) ..... 1150365

(51) Int. Cl.
*B25D 9/26* (2006.01)
*B25D 9/18* (2006.01)
(Continued)

(52) U.S. Cl.
CPC . *B25D 9/26* (2013.01); *E21B 4/14* (2013.01); *B25D 2250/371* (2013.01)

(58) Field of Classification Search
CPC ..... B25D 9/26; B25D 9/18; B25D 11/005
(Continued)

(56) References Cited

U.S. PATENT DOCUMENTS 3,780,621 A 12/1973 Romell
4,006,783 A * 2/1977 Granholm ..... B25D 9/145 173/105

(Continued)

FOREIGN PATENT DOCUMENTS

EP 0080446 6/1983
EP 0112810 7/1984

(Continued)

*Primary Examiner* — Andrew M Tecco
*Assistant Examiner* — Praachi M Pathak
(74) *Attorney, Agent, or Firm* — Mark P. Stone

(57) ABSTRACT

The invention relates to an impact mechanism comprising a housing (32) with at least two stroke adjustment channels (18, 19, 20); an adjustment arrangement (31) with at least two adjustment pin channels (35, 36, 37, 135, 136, 137) arranged to interact in a manner that can be selected with the stroke adjustment channels (18, 19, 20); and a hammer piston (1) that performs reciprocating motion in the housing (32) in order to impact repetitively onto an anvil (2), which hammer piston (1) has a stroke length that can be selected with the aid of adjustment pin channels (35, 36, 37, 135, 136, 137) and the stroke adjustment channels (18, 19, 20). According to the invention, the adjustment arrangement (31) comprises an elastic element (48) arranged to maintain the adjustment arrangement (31) in place for the stroke length that has been selected; and an operating means (34) arranged to select adjustment pin channel (35, 36, 37, 135, 136, 137) and thus the stroke length of the hammer piston (1).

20 Claims, 10 Drawing Sheets

(51) Int. Cl.
*B25D 11/00* (2006.01)
*E21B 4/14* (2006.01)

(58) Field of Classification Search
USPC ..... 173/200, 201, 115
See application file for complete search history.

(56) References Cited

U.S. PATENT DOCUMENTS

| | | | | | |
|---|---|---|---|---|---|
| 4,062,411 | A | * | 12/1977 | Adkins | B25D 9/26 173/115 |
| 4,413,687 | A | | 11/1983 | Eklof | |
| 4,733,731 | A | | 3/1988 | Tkach et al. | |
| 5,129,466 | A | * | 7/1992 | Bartels | B25D 9/26 173/13 |
| 5,669,281 | A | | 9/1997 | Comarmond | |

FOREIGN PATENT DOCUMENTS

| | | |
|---|---|---|
| EP | 0 739 691 | 10/1996 |
| WO | WO2006/054949 | 5/2006 |
| WO | WO2007/097677 | 8/2007 |
| WO | WO2008/033075 | 3/2008 |

* cited by examiner

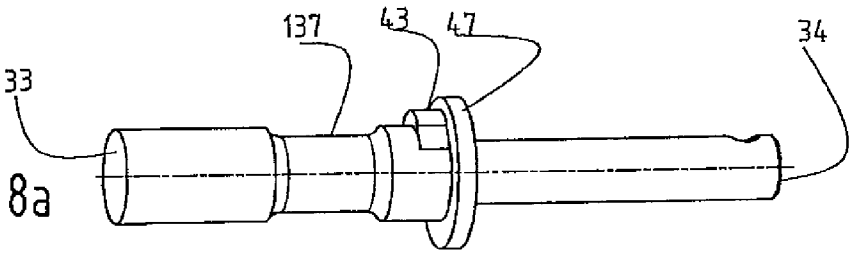
Fig. 8a
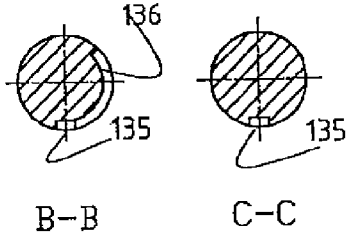
Fig. 8b
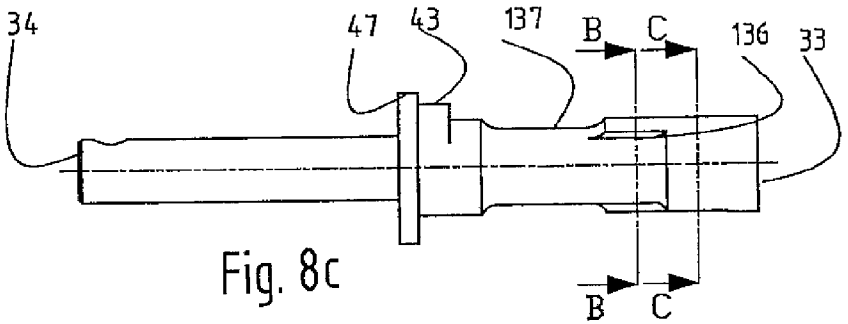
Fig. 8c
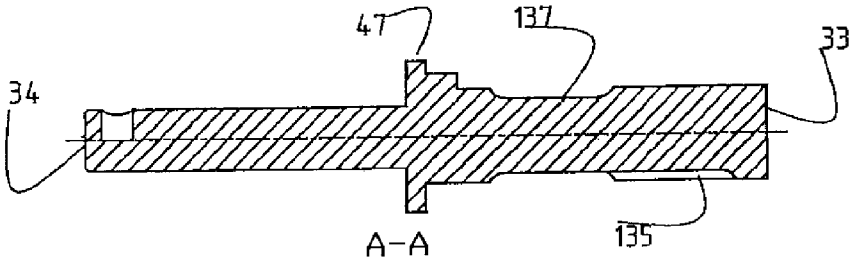
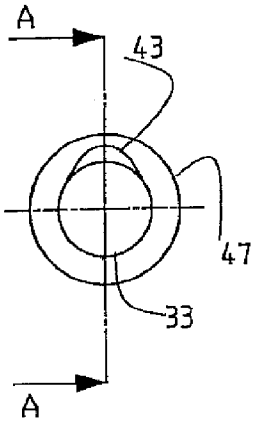

IMPACT MECHANISM, ROCK DRILL AND DRILL RIG COMPRISING SUCH IMPACT MECHANISM

TECHNICAL AREA

The present invention concerns an impact mechanism according to the introduction of claim 1.

THE PRIOR ART

In rock drills and other hydraulic impact mechanisms, a hammer piston performs reciprocating motion in a cylindrical housing and makes repetitive impacts onto a shank adapter or other type of anvil. The length of stroke is the distance that the hammer piston travels between the positions at which the hammer piston changes its direction of motion. The stroke length can be controlled with the aid of a stroke adjustment arrangement, such as in the form of a stroke adjustment pin, in such a manner that the adjustment of the adjustment arrangement selects between different channels or combinations of channels, which influences, for example, the position at which the hammer piston is to change its direction of motion at the rear position. The energy and frequency of the impacts are in this way influenced.

Several different variants of stroke adjustment arrangements are available. U.S. Pat. No. 4,413,687 reveals a drill in which the operator must first withdraw a spring-loaded locking pin from a recess in the adjustment pin. The operator must subsequently continue to apply a force onto the locking pin in order to hold the locking pin away from the adjustment pin, while the adjustment pin is axially displaced. The locking pin can subsequently be placed into another recess in the adjustment pin. The disadvantage is that two hands are required to change the stroke length. Since the spring-load locking pin is externally located, it will be influenced by rough handling and there is a risk that its lifetime will be short.

U.S. Pat. No. 3,780,621 reveals a drill in which a locking screw must be removed from a pin in order to change the stroke length. The pin can subsequently be axially displaced and the locking screw is used to lock the pin in its new position. The disadvantage is that tools are required to change the stroke length.

An adjustment pin for the changing of stroke length is shown on Page 56 of the Atlas Copco manual, fourth edition, published by Ljungföretagen AB, Örebro, Sweden in 1982. The adjustment pin has three channels along the axis for the selection of stroke length, which channels can be selected by loosening a nut, turning the pin, and then retightening the nut. The disadvantage is that tools are required to change the stroke length.

Various variants of more or less automatic adjustment of stroke length are revealed in, for example, EP0 080 446, EP0 112 810, WO2007/097677 and WO2008/033075. These work well, but are also complicated and consequently expensive.

DESCRIPTION OF THE INVENTION

The purpose of the present invention is to solve the problems of adjusting the stroke length using prior art technology. This purpose is achieved according to the invention through the distinctive features in claim 1.

The advantages are that the stroke length can be changed manually, with one hand, in a rapid, simple and cheap manner, without the need of tools or complicated constructions.

DESCRIPTION OF DRAWINGS

The invention will be explained in more detail with the aid of a preferred embodiment and with reference to the attached drawings, of which:

FIGS. 5*a-c* and 6*a-c* show a third embodiment in cross-sections, overview and side view.

FIGS. 7*a-c* and 8*a-c* show a fourth embodiment in cross-sections, overview and side view.

PREFERRED EMBODIMENT

Figure 1A:
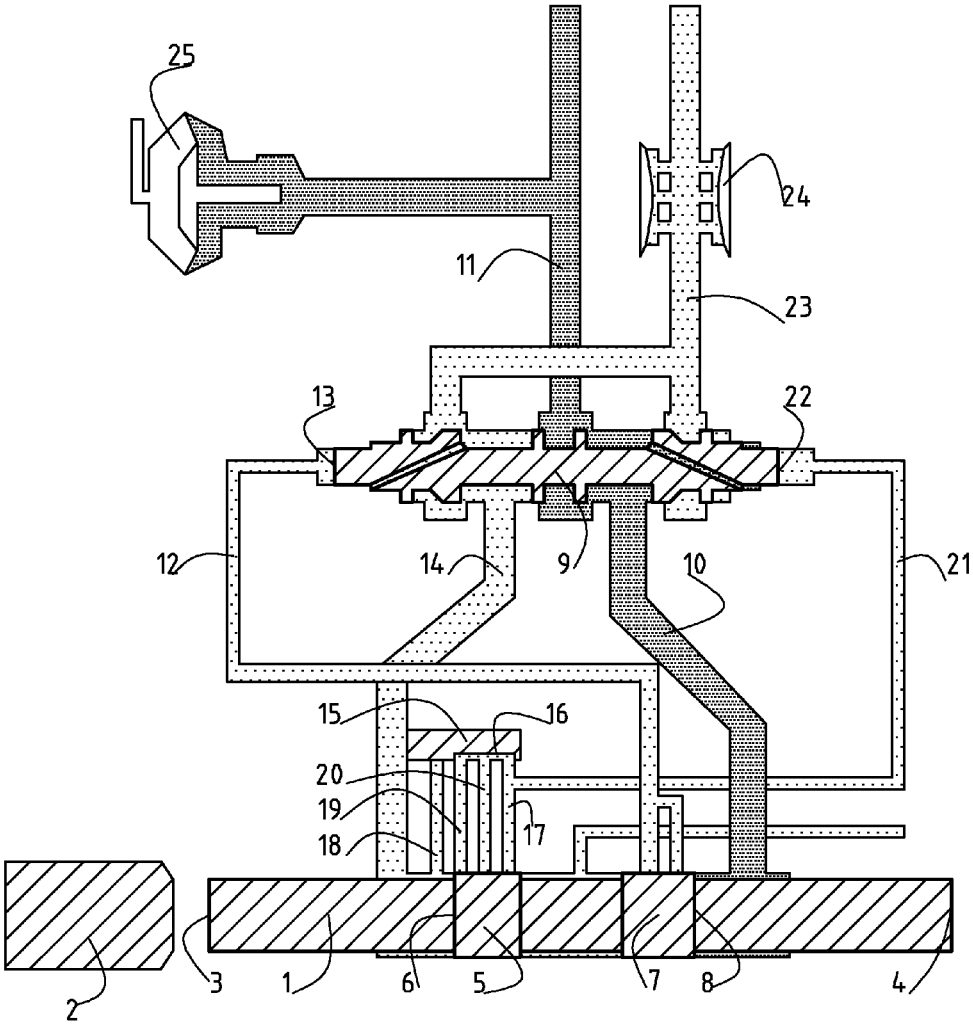
FIGS. 1*a-d* show an overview of how an impact mechanism works and how change of the stroke length can be carried out.

FIGS. 1*a-d* show schematically a prior art hydraulic down-the-hole impact drill with an impact mechanism of the alternating pressure type, arranged in a housing. The impact mechanism comprises a hammer piston 1 that moves forwards and backwards and impacts upon a shank adapter 2 or similar. The shank adapter 2 then transfers the impact energy through a drill string (not shown in the drawings) and a drill bit (not shown in the drawings) to the rock.

The forward end 3 of the hammer piston is here denoted as the end that makes impact with the shank adapter 2, while the rear end 4 of the hammer piston is the end that is directed away from the shank adapter 2. The hammer piston 1 in this example comprises a forward piston boom 5 with a forward driving area 6, and a rear piston boom 7 with a rear driving area 8. The forward and backward motion is controlled with the aid of a valve piston 9 and a number of channels. An intake accumulator 25 and a return accumulator 24 even out peaks of pressure during the process.

The valve piston 9 is in its first position in FIG. 1*a*. A forward signal channel 10 is open to high pressure 11, through the valve piston 9, to the rear driving area 8 of the hammer piston. A backwards signal channel 14 is open from the forward driving area 6 of the hammer piston, through the valve piston 9, to low pressure 23.

This gives a pressure of the rear driving area 8 of the hammer piston, but not on the forward driving area 6 of the hammer piston, which causes the hammer piston 1 to move forwards towards the shank adapter 2. The rear piston boom 7 blocks a passage to a first adjustment channel 12, which later will cause a reversal of the motion of the piston.

Figure 1B:
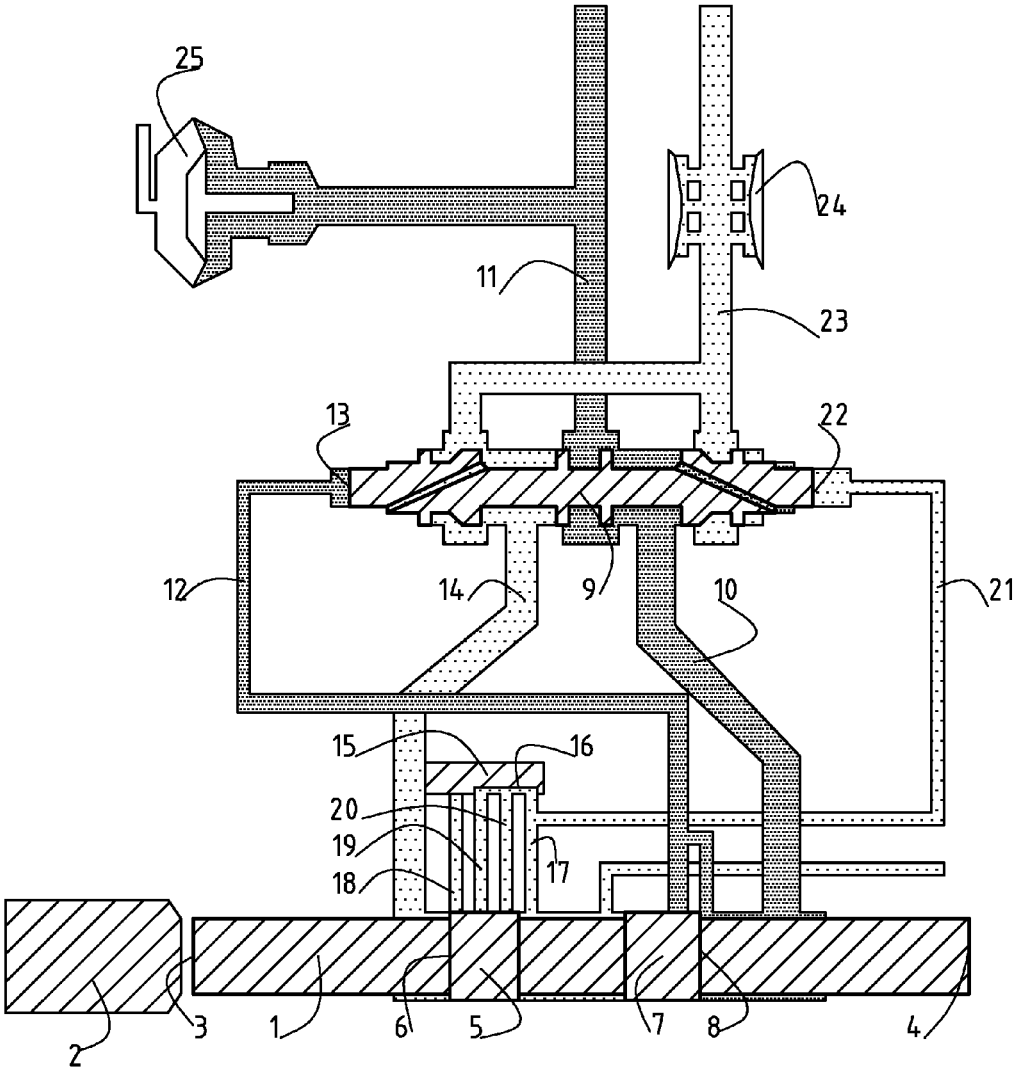

The hammer piston 1 continues its motion forwards in FIG. 1*b*. When the hammer piston 1 approaches the shank adapter 2, the rear piston boom 7 no longer blocks passage to the first adjustment channel 12. This causes the first adjustment area 13 of the valve piston to be placed under pressure, which causes the valve piston 9 to move to its second position.

Figure 1C:
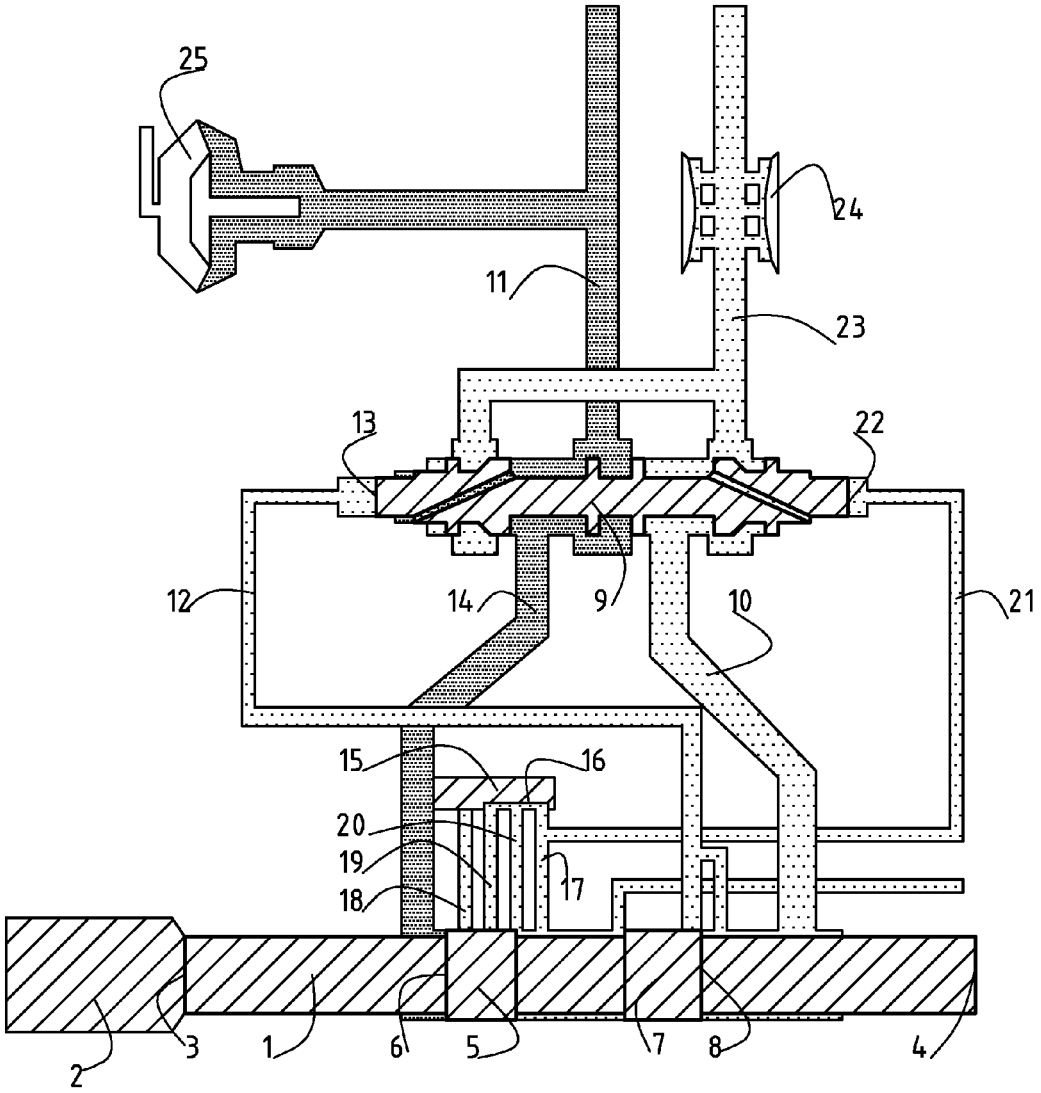

The valve piston 9 has moved to its second position in FIG. 1*c*. In this way, the backwards signal channel 14 is instead open to high pressure 11, through the valve piston 9, to the forward driving area 6 of the hammer piston. The passage from high pressure 11 to the forward signal channel 10 is closed, such that the rear driving area 8 of the hammer piston is no longer under pressure, and is instead connected to low pressure 23 through the valve piston 9. This change in pressure changes the direction of motion of the hammer piston 1, such that the hammer piston 1 is instead forced backwards.

Figure 1D:
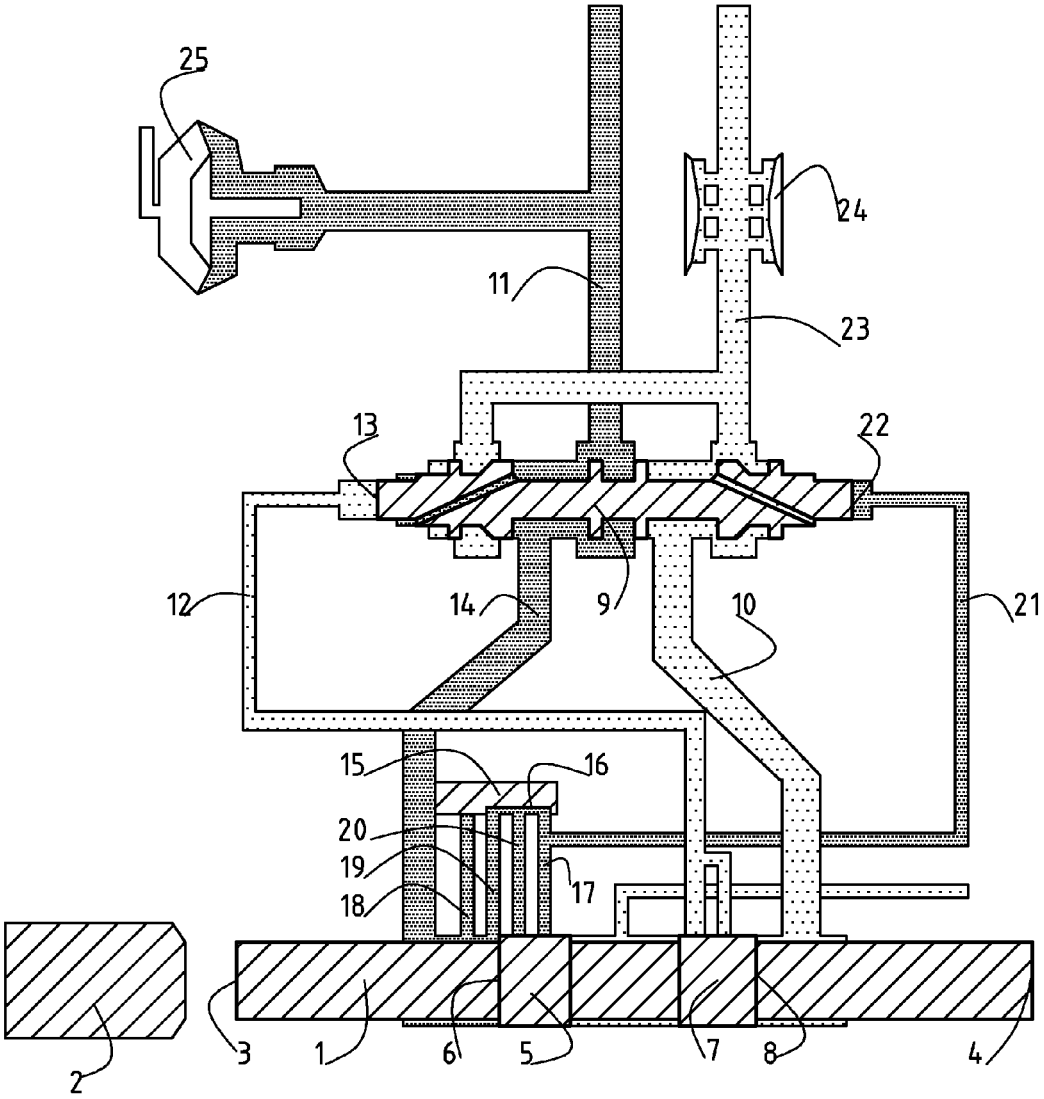
Figure 2A:
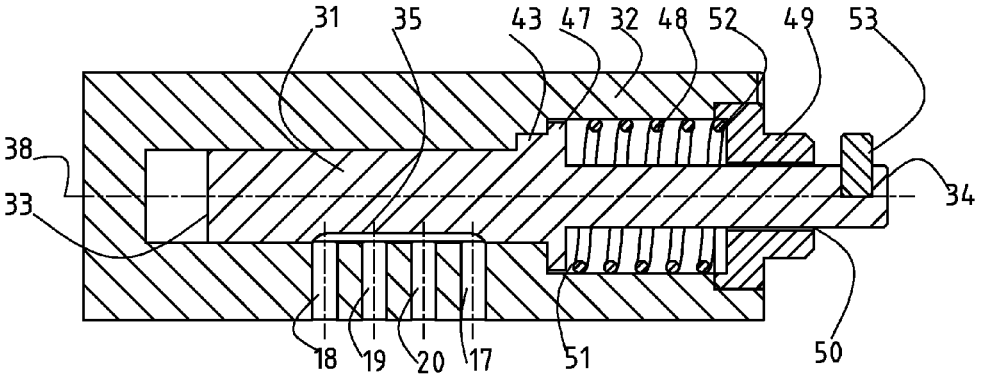
FIGS. 2*a-c* and 3*a-c* show a first embodiment in cross-sections, overview and side views.
Figure 2B:
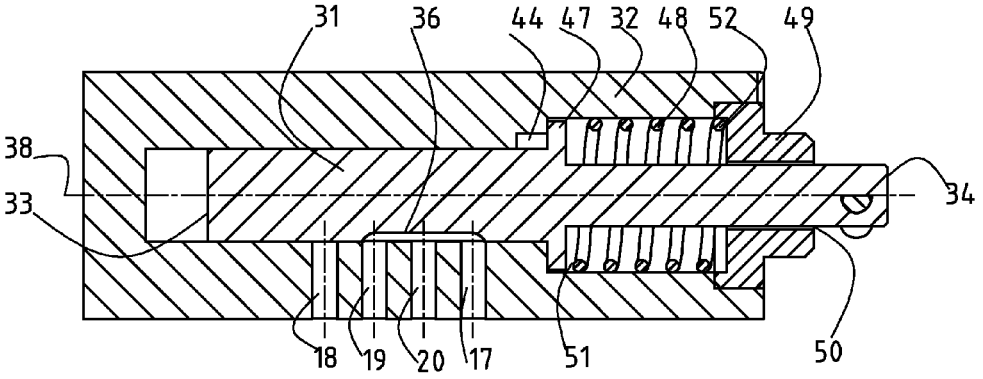
Figure 2C:
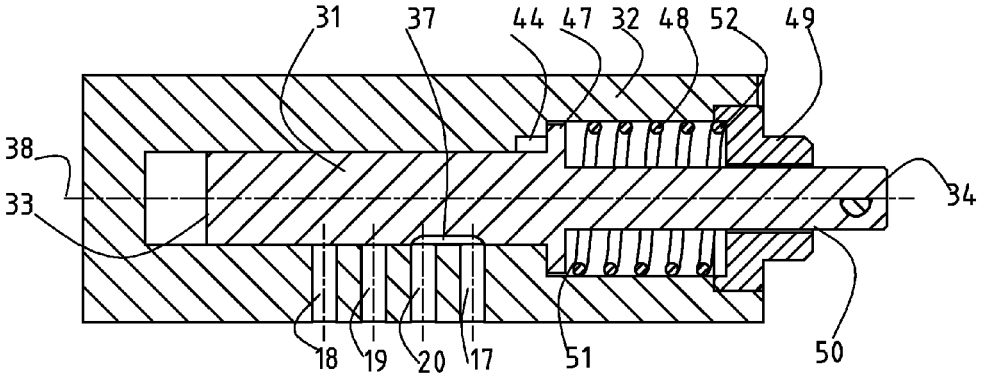

The hammer piston 1 is moving backwards in FIG. 1*d*. An adjustment arrangement in the form of an adjustment pin 15 makes it possible to set the length of the stroke. The adjustment pin 15 in this example has a first adjustment pin channel (not shown), a second adjustment pin channel 16 and a third adjustment pin (not shown). A fundamental stroke adjustment channel 17, a first stroke adjustment channel 18, a second stroke adjustment, channel 19 and a third stroke adjustment channel 20 are present in the housing. The fundamental stroke adjustment channel 17 is connected through a second adjustment channel 21 to the second adjustment area 22 of the valve piston.

If the adjustment pin 15 is placed into a first position, the first adjustment pin channel will connect the fundamental stroke adjustment channel 17 with the first stroke adjustment channel 18. If the adjustment pin 15 is placed into a second position, the second adjustment pin channel 16 will connect the fundamental stroke adjustment channel 17 with the second stroke adjustment channel 19. If the adjustment pin 15 is placed into a third position, the third adjustment pin channel will connect the fundamental stroke adjustment channel 17 with the third stroke adjustment channel 20.

The adjustment pin 15 is shown in FIG. 1*d* in its second position. When the hammer piston 1 during its backwards motion opens the first stroke adjustment channel 18 to pressure 11, nothing will happen, since the first stroke adjustment channel 18 in this position is not connected to the fundamental stroke adjustment channel 17.

When the hammer piston 1 has moved a small distance further backwards, however, the second stroke adjustment channel 19 is opened to pressure. The second adjustment pin channel 16 connects the second stroke adjustment channel 19 with the fundamental stroke adjustment channel 17, and thereby with the second adjustment channel 21 and the second adjustment area 22 of the valve piston. This causes the second adjustment area 22 of the valve piston to be placed under pressure, which causes the valve piston 9 to move to its first position. The passage to the backwards signal channel 14 is closed, such that the forward driving area 6 of the hammer piston is no longer placed under pressure. The hammer piston 1 is in this way forced to change direction and move forwards again, and the stroke cycle begins again according to FIG. 1*a*.

If the adjustment pin 16 had instead been placed into its first position, the second adjustment area 22 of the valve piston would have been placed under pressure already when the hammer piston 1 passed the first stroke adjustment channel 18. The hammer piston 1 would therefore have changed direction earlier. In a corresponding manner, if the adjustment pin 16 had been placed into its third position, the second adjustment area 22 would not have been placed under pressure until the hammer piston 1 had passed the third stroke adjustment channel 20. The hammer piston 1 would therefore have changed direction later. The stroke length of the hammer piston 1 can in this way be selected, and in association with this, impacts of different energy and frequency can be obtained.

The adjustment pin 15 in FIGS. 1*a-d* can be adjusted as stated in the Atlas Copco manual above, through the adjustment pin 15 having several adjustment pin channels that can be selected by means of rotation through first unscrewing a nut, then rotating the adjustment pin to another position, and then rescrewing the nut. Another alternative is to remove the adjustment pin 15 by unscrewing and to exchange it for another type with another adjustment pin channel. Both alternatives require a tool and are therefore difficult to carry out.

A solution according to the invention is shown in the following drawings, which solution can be used in, for example, an impact mechanism of the alternating pressure type described above, or similar, instead of the adjustment pin 15 shown in the drawings. The invention can be used also in impact mechanism of the constant pressure type and in other conceivable impact mechanisms in which it is necessary to adjust the stroke length. It is not relevant whether the hammer piston impacts onto a shank adapter, as described above, or directly onto the drill bit or drill string, or alternatively onto a chisel or similar. All of these can be regarded as variants of an anvil onto which to make impacts.

Figure 3A:
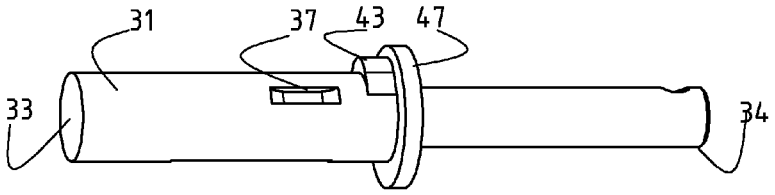
Figure 3B:
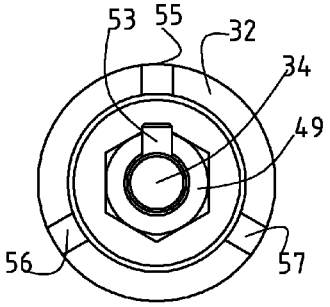
Figure 3C:
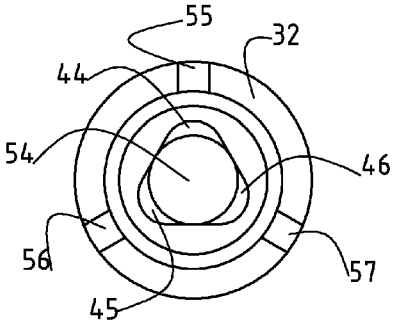

An adjustment arrangement in the form of an adjustment pin 31 or similar, mounted in a housing 32 in an impact mechanism is shown in FIGS. 2*a-c* and 3*a-c*. FIG. 3*a* shows only the adjustment pin 31. FIG. 3*c* shows only the housing 32, seen from the side. FIGS. 2*a-c* and FIG. 3*b* show the housing 32 with the adjustment pin 31 mounted.

The adjustment pin has an inner end 33 and an outer end 34. The adjustment pin 31 has a first groove 35, a second groove 36 and a third groove 37. It is preferable that these grooves be longitudinal grooves milled along the axis 38 of the adjustment pin, and that they be separated from each other. The grooves 35, 36, 37 have the function of the adjustment pin channels described above, and they can, as has been described above, be used to connect a fundamental stroke adjustment channel 17 in the housing with a first stroke adjustment channel 18, a second stroke adjustment channel 19 or a third stroke adjustment channel 20, respectively. It is thus possible to select an adjustment pin channel and in this way to select a stroke adjustment channel by means of rotation.

These adjustment pin channels 35, 36, 37 and stroke adjustment channels 18, 19, 20 may be designed in different manners: the number of channels and their appearance is not relevant, as long as a similar function is carried out. In particular, the number of channels may be two or four, just as advantageously as three.

There is preferably an attachment arrangement 43 on the adjustment pin 31 in the form of a peg 43 or similar, which here has the shape of an egg but may have another appearance. The peg 43 fits into an attachment arrangement 44, 45, 46 in the housing in the form of three indentations 44, 45, 46. By selecting the indentation 44, 45, 46 with which the peg is brought into contact, also the amount by which the adjustment pin 31 is to be rotated is selected, and thus also which of the adjustment pin channels 35, 36, 37 and—by extension—which of the stroke adjustment channels 18, 19, 20 is to be selected. In this way the stroke length is selected: compare this with the description above.

Figure 4A:
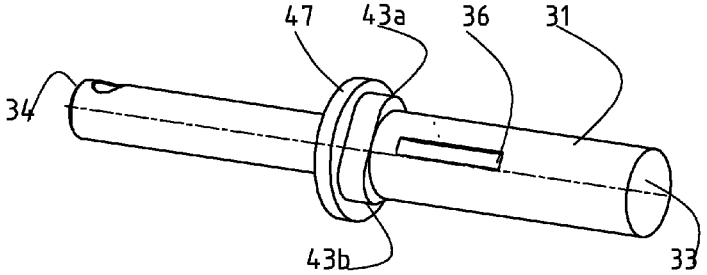
FIGS. 4*a-c* show an overview and side views of a second embodiment.
Figure 4B:
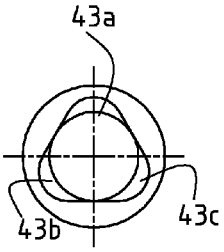
Figure 4C:
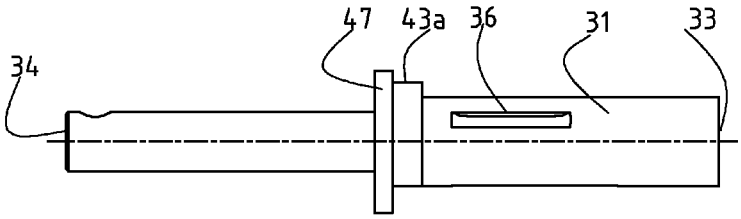
Figure 5A:
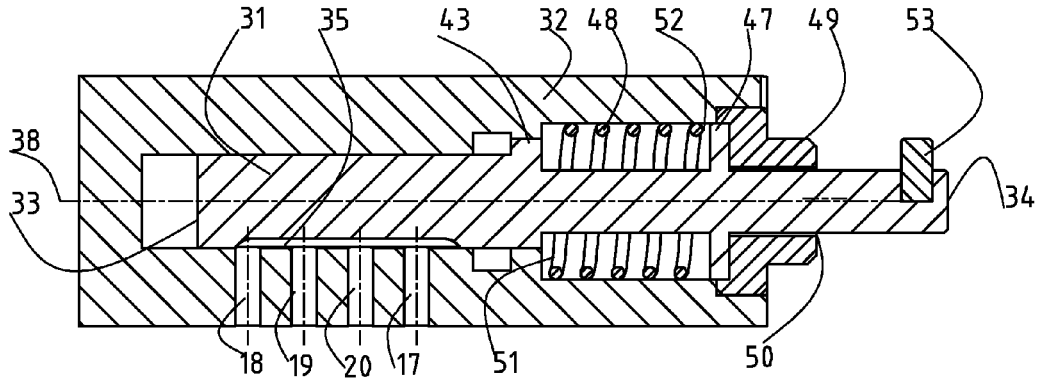
Figure 5B:
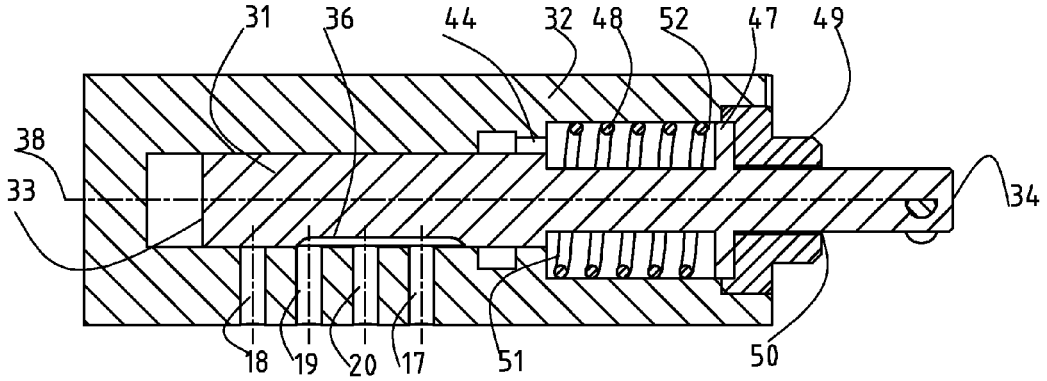
Figure 5C:
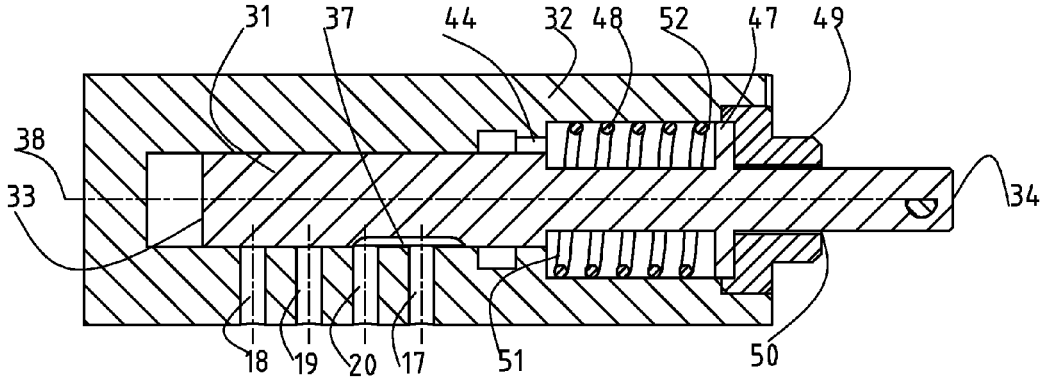

In order to obtain higher strength, the adjustment pin 31 may have two or three pegs 43*a*, 43*b*, 43*c* circularly arranged around the adjustment pin 31, such that they can make contact with more than one indentation 44, 45, 46 at the same time, see the example shown in FIGS. 4*a-c*.

Alternatively, and in contrast, the peg or pegs may be arranged in the housing 32, while the indentations are arranged in the adjustment pin 31. Also other attachment arrangements may be conceived without changing the function.

The adjustment pin 31 may be mounted in the housing with the aid of, for example, a nut 49 with a hole 50, through which the outer end 34 of the adjustment pin can pass.

A flange or similar 47 is present on the adjustment pin 31, as is also an elastic element in the form of a spring 48 or similar that in its tensioned condition makes contact at one 51 of its ends with the flange 47 and at the other 52 of its ends with the nut 49 or with another part of the housing 32. The nut 49 or other parts attached to the housing 32 in this context are to be considered to be a part of the housing 32.

Through the adjustment pin 31 being placed under axial spring-load in this manner, the peg 43 is held in place in the selected indentation 44, 45, 46, which ensures that the adjustment pin channels 35, 36, 37 are held in place and function as intended.

A further alternative is that the flange 47 itself be designed as three pegs that are sufficiently broad for the spring 48 to be able to make contact also with them.

In order to change the adjustment pin channel 35, 36, 37 and thus also the stroke length, the operator pulls the outer end 34 of the adjustment pin or another corresponding operating means 34 and thus compresses the spring 48. The operator pulls until the peg 43 becomes released from the indentation 44, 45, 46. It is now possible to rotate the adjustment pin 31, and it is possible to fit it into another indentation 44, 45, 46. When the operator releases the outer end 34 of the adjustment pin, the spring force will cause the adjustment pin to regain its position, while the peg 43 is held fast in a new indentation 44, 45, 46.

The outer end 34 of the adjustment pin may be provided with a pin 53 or similar in order to either facilitate grip on the adjustment pin 31 or indicate which of the three positions the adjustment pin 31 has been set against markings 55, 56, 57 on the housing, or both facilitate grip on the adjustment pin 31 and indicate which of the three positions the adjustment pin 31 has been set against markings 55, 56, 57 on the housing.

An embodiment is shown in FIGS. 5*a-c* and 6*a-b* in which the spring 48 is arranged such that the outermost end 34 is depressed instead of being withdrawn during change of the adjustment pin channel 35, 36, 37, whereby the spring 48 is compressed in order to release the peg 43 from the indentation 44.

Figure 6B:
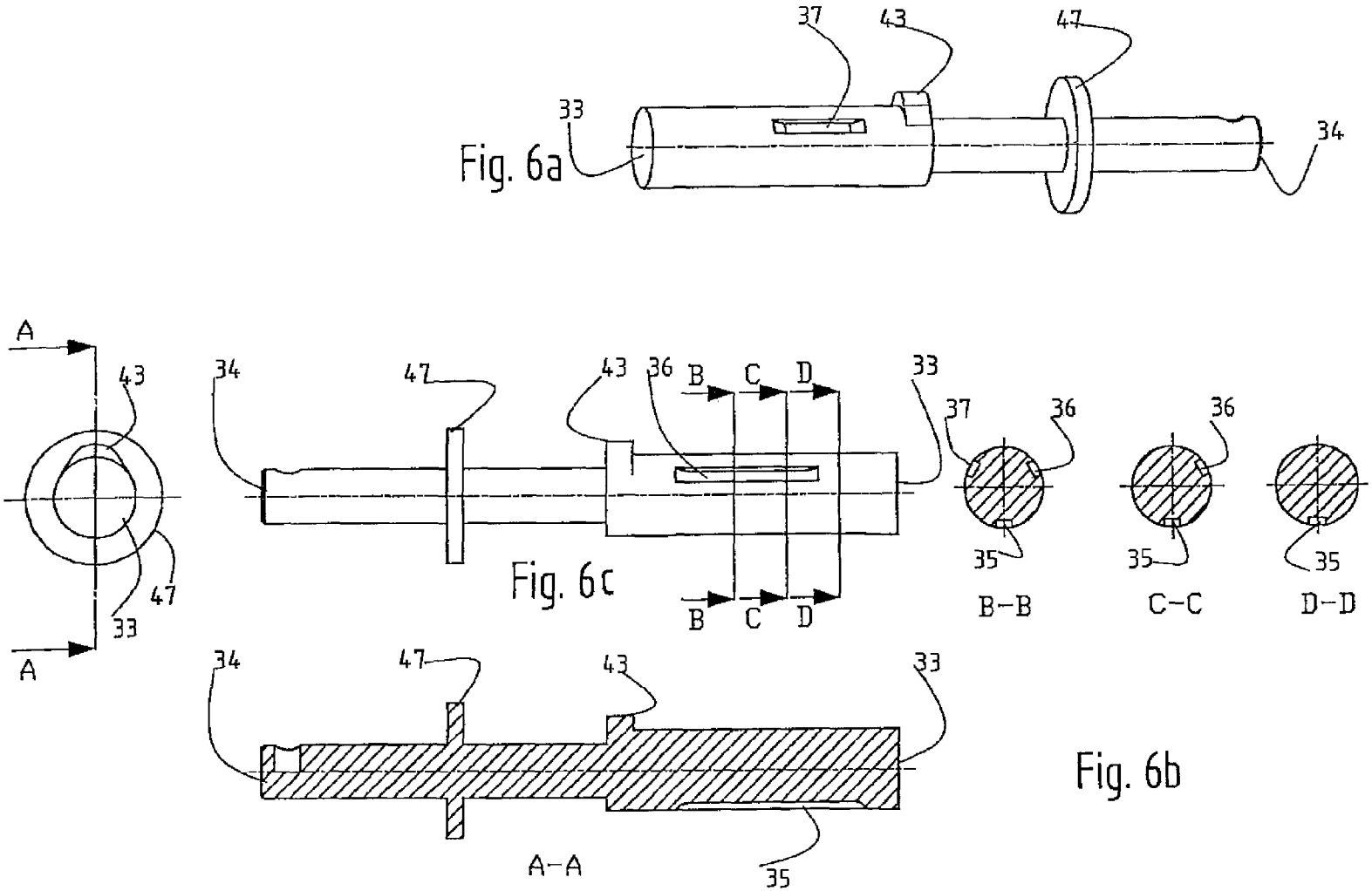
Figure 7A:
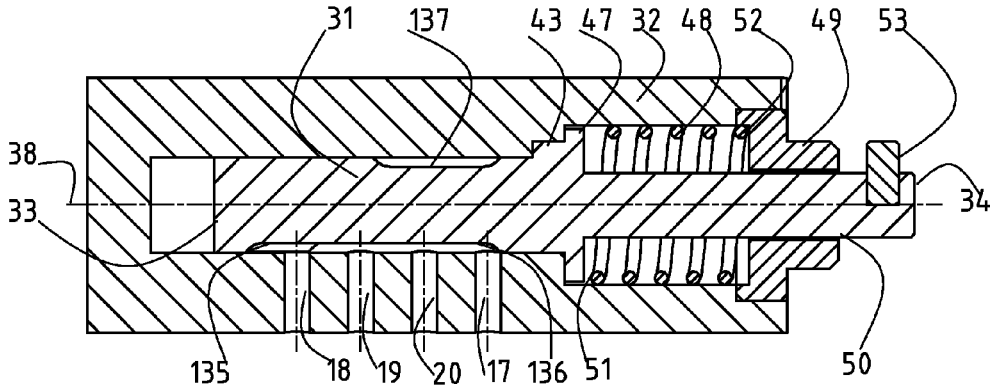
Figure 7B:
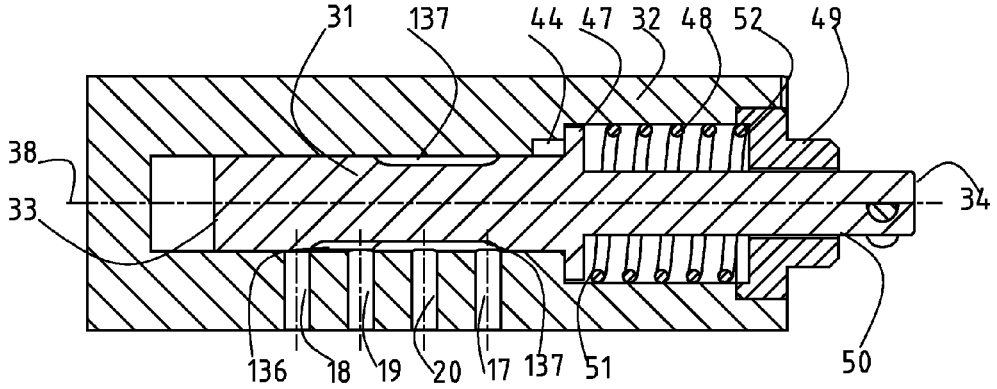
Figure 7C:
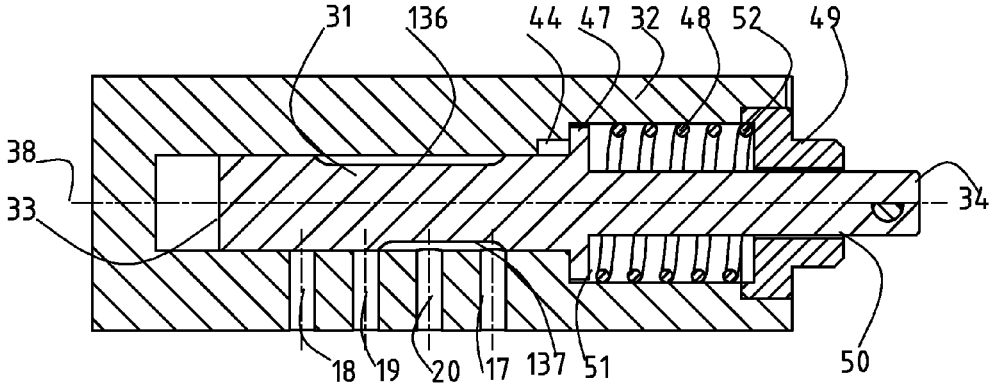

FIG. 6*b* shows in cross-section also how the adjustment pin channels 35, 36, 37 are separated from each other.

Also other variants of elastic elements 48 can be envisioned such as, for example, elements that are pulled apart rather than being compressed. This is the case for all embodiments.

FIGS. 7*a-c* and 8*a-b* show a further embodiment. It is necessary in the embodiments previously described that the impact mechanism is not in operation in order to be able to adjust the stroke length. The adjustment pin channels 35, 36, 37 in these cases included grooves or similar that were separated from each other.

In contrast, FIGS. 7*a-c* and 8*a-b* show three adjustment pin channels 135, 136, 137 that transition into each other. This ensures that, independently of how the adjustment pin 31 has been rotated, a connection will always be formed between the fundamental stroke adjustment channel 17 and one of the stroke adjustment channels 18, 19, 20, and this in turn ensures that the impact mechanism can function, independently of how the adjustment pin 31 has been rotated.

The attachment arrangements 43 and 44 are loosened in FIGS. 7*a-c* and 8*a-b* from each other through the outer end 34 being pulled out. In order for a connection between the fundamental stroke adjustment channel 17 and one of the stroke adjustment channels 18, 19 20 to be maintained also when the outer end 34 is pulled out, the adjustment pin channels 135, 136, 137 in the embodiment shown in FIGS. 7*a-c* and 8*a-b* are longer than in the previously shown embodiments.

The corresponding is, of course, true if the embodiment shown in FIGS. 5*a-c* and 6*a-b* is designed in a corresponding manner with adjustment pin channels that transition into each other, whereby the extension of the adjustment pin channels, naturally, must be made in the other direction, in order to make possible change of stroke length through the outer end 34 being depressed instead.

The invention is, of course, not limited to the example described above: it can be modified within the framework of the attached claims.

The invention claimed is:

1. An impact mechanism comprising a housing with at least two stroke adjustment channels; an adjustment pin having longitudinal grooves, arranged along the axis of the adjustment pin and separated around the adjustment pin, said longitudinal grooves forming adjustment pin channels arranged for freely chosen interaction with the stroke adjustment channels; and a hammer piston that performs reciprocating motion in the housing in order to repetitively impact onto an anvil, which hammer piston has a stroke length that can be selected with the aid of said adjustment pin channels and the stroke adjustment channels, and an elastic element arranged to maintain the adjustment pin in position for the stroke length that has been selected; and an operating means arranged to select one of said adjustment pin channels by means of rotation of the adjustment pin and thus the stroke length of the hammer piston.

2. The impact mechanism according to claim 1, wherein the operating means is an outer end of the adjustment pin.

3. The impact mechanism according to claim 2, wherein the anvil is any one of the group: shank adapter, drill string, drill bit, chisel.

4. The impact mechanism according to claim 1, wherein the adjustment pin channels are arranged such that the adjustment pin channels transition into each other.

5. The impact mechanism according to claim 1, wherein the anvil is any one of the group: shank adapter, drill string, drill bit, chisel.

6. A rock drill comprising an impact mechanism according to claim 1.

7. A drilling rig comprising a rock drill according to claim 6.

8. The impact mechanism according to claim 1, wherein the adjustment pin comprises an attachment arrangement arranged to fit into a corresponding attachment arrangement in the housing in such a manner that the attachment arrangement of the adjustment pin and the attachment arrangement of the housing fit together with each other in at least two different ways, and such that the adjustment pin channel is selected depending on how the attachment arrangement of the housing and the attachment arrangement of the adjustment pin are united.

9. The impact mechanism according to claim 8, wherein the operating means is arranged to loosen the attachment arrangement of the adjustment pin from the attachment arrangement of the housing when the operating means is pulled from the housing.

10. The impact mechanism according to claim 8, wherein the attachment arrangement of the adjustment pin comprises at least one peg and the attachment arrangement of the housing comprises at least one indentation.

11. The impact mechanism according to claim 8, wherein the attachment arrangement of the adjustment pin comprises at least one indentation and the attachment arrangement of the housing comprises at least one peg.

12. The impact mechanism according to claim 8, wherein the operating means is arranged to loosen the attachment arrangement of the adjustment arrangement from the attachment arrangement of the housing when the operating means is pressed into the housing.

13. The impact mechanism according to claim 1, wherein the elastic element comprises a spring.

14. An impact mechanism comprising a housing with at least two stroke adjustment channels; an adjustment arrangement with at least two adjustment pin channels arranged for freely chosen interaction with the stroke adjustment channels; and a hammer piston that performs reciprocating motion in the housing in order to repetitively impact onto an anvil, which hammer piston has a stroke length that can be selected with the aid of adjustment pin channels and the stroke adjustment channels, wherein the adjustment arrangement comprises an elastic element arranged to maintain the adjustment arrangement in position for the stroke length that has been selected; and an operating means arranged to select adjustment pin channel and thus the stroke length of the hammer piston, wherein the adjustment arrangement comprises an attachment arrangement arranged to fit into a corresponding attachment arrangement in the housing in such a manner that the attachment arrangement of the adjustment arrangement and the attachment arrangement of the housing fit together with each other in at least two different ways, and such that the adjustment pin channel is selected depending on how the attachment arrangement of the housing and the attachment arrangement of the adjustment arrangement are united.

15. The impact mechanism according to claim 14, wherein the attachment arrangement of the adjustment arrangement comprises at least one peg and in that the attachment arrangement of the housing comprises at least one indentation.

16. The impact mechanism according to claim 14, wherein the attachment arrangement of the adjustment arrangement comprises at least one indentation and in that the attachment arrangement of the housing comprises at least one peg.

17. The impact mechanism according to claim 14, wherein the operating means is arranged to loosen the attachment arrangement of the adjustment arrangement from the attachment arrangement of the housing when the operating means is pulled from the housing.

18. The impact mechanism according to claim 14, wherein the operating means is arranged to loosen the attachment arrangement of the adjustment arrangement from the attachment arrangement of the housing when the operating means is pressed into the housing.

19. The impact mechanism according to claim 14, wherein the elastic element comprises a spring.

20. The impact mechanism according to claim 14, wherein the operating means is an outer end of the adjustment arrangement.

* * * * *